US007387553B1

(12) United States Patent
Misorski et al.

(10) Patent No.: US 7,387,553 B1
(45) Date of Patent: Jun. 17, 2008

(54) MARINE DRIVE UNIT OVERMOLDED WITH A POLYMER MATERIAL

(75) Inventors: Christopher J. Misorski, Fond du Lac, WI (US); Kevin R. Anderson, Fond du Lac, WI (US); Mitesh B. Sheth, Fond du Lac, WI (US); Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 418 days.

(21) Appl. No.: 10/780,342

(22) Filed: Feb. 17, 2004

(51) Int. Cl.
*B63H 20/32* (2006.01)

(52) U.S. Cl. ..... 440/78

(58) Field of Classification Search ..... 440/57, 440/76, 77, 78; 114/222; 204/196.15, 196.17, 204/196.18; 428/472.3; 15/22.1
See application file for complete search history.

(56) References Cited

U.S. PATENT DOCUMENTS 3,939,795 A * 2/1976 Rocka ..... 440/78
5,011,583 A 4/1991 Tanbara ..... 204/148
5,069,643 A * 12/1991 Westberg et al. ..... 440/77
5,139,449 A * 8/1992 Akahori ..... 440/76
5,487,687 A 1/1996 Idzikowski et al. ..... 440/77
5,656,376 A 8/1997 Rafferty et al. ..... 428/413
5,718,014 A * 2/1998 deBlois et al. ..... 15/22.1
6,173,669 B1 1/2001 Staerzl ..... 114/222
6,209,472 B1 4/2001 Staerzl ..... 114/222
6,312,821 B1 * 11/2001 Takasaki et al. ..... 428/472.3
6,468,119 B1 10/2002 Hasl et al. ..... 440/57
6,547,952 B1 4/2003 Staerzl ..... 205/724

* cited by examiner

*Primary Examiner*—Lars A Olson
(74) *Attorney, Agent, or Firm*—Andrus, Sceales, Starke & Sawall, LLP; William D. Lanyi

(57) ABSTRACT

A marine propulsion system drive unit is provided with a polymer layer to protect its outer surface from abrasion and corrosion. The polymer layer is injection molded around the outer surface of a metallic gear case structure or drive shaft housing to provide a coat which is approximately 3 millimeters thick and which will resist scratching and corrosion. The polymer layer can be a glass filled polymer or a carbon filled polymer. An adhesion promoter can be used to enhance the bonding and intimate contact between the inner surface of the polymer layer and the outer surface of the metallic gear case structure or drive shaft housing.

3 Claims, 4 Drawing Sheets

MARINE DRIVE UNIT OVERMOLDED WITH A POLYMER MATERIAL

BACKGROUND OF THE INVENTION

1. Field of the Invention

The present invention is generally related to a marine propulsion system and, more particularly, to a marine propulsion system in which the drive unit is overmolded with a thin overmolded layer of a polymer material to protect the metallic drive unit from corrosion.

2. Description of the Prior Art

Those skilled in the art of marine propulsion systems are aware that metallic drive units are subject to corrosion, particularly when used in salt water. In order to inhibit corrosion of the metallic drive unit, the gear case and drive shaft housing are often painted with a corrosion inhibiting primer and at least one coat of paint. However, when the paint is scratched or gouged, the protective characteristic of the primer and paint coats can become severely degraded.

Those skilled in the art of polymer materials and overmolding techniques are well aware of many products on which a polymer overmolded layer is used to seal or protect a surface of an object.

U.S. Pat. No. 5,487,687, which issued to Idzikowski et al. on Jan. 30, 1996, discloses a midsection and cowl assembly for an outboard marine drive. The drive has a midsection between the upper power head and the lower gear case and has a removable midsection cowl assembly including first and second cowl sections. The midsection housing includes an oil sump in one embodiment and further includes an exhaust passage partially encircled by cooling water and partially encircled by engine oil for muffling engine exhaust noise. The midsection housing also has an oil drain arrangement providing complete and clean oil draining while the outboard drive is mounted on a boat and in the water wherein the operator can change oil without leaving the confines of the boat and entering the water.

U.S. Pat. No. 6,468,119, which issued to Hasl et al. on Oct. 22, 2002, describes a composite sterndrive assembly. The assembly is configured for utilization in an inboard/outboard power plant for a boat. The sterndrive assembly includes a central rigid core that is configured at an upper portion to be coupled to the stern of a carrying boat. A lower portion of the core is designed to accept a boat moving force generated by a water propulsion unit that is coupled thereto. A thin-walled housing is configured to be secured about a predominance of the centrally located rigid core. The housing has an outer surface that establishes an exterior of the sterndrive assembly and an inner surface directed generally toward the central rigid core. A portion of an exterior surface of the central rigid core is configured to cooperate with a corresponding portion of the inner surface of the thin-walled housing. These two portions, when in cooperative orientation one with the other, form a functional feature for the sterndrive assembly.

U.S. Pat. No. 5,656,376, which issued to Rafferty et al. on Aug. 12, 1997, describes composite and fairwater structures for marine vessels. In a marine vessel having a drive shaft that extends rearwardly from its hull, wherein the drive shaft has a coupling and a bearing assembly along its length that are supported by struts, which struts are also secured to the hull of the vessel, a coupling cover encompasses a coupling and is mounted adjacent to a bearing assembly. A fairwater encompasses the coupling cover and is attached to the bearing assembly for the strut associated therewith to define a chamber and a clearance space between the fairwater and the coupling cover for directing fluids therethrough and through the bearing assembly to lubricate such bearing assembly. Vanes are located on the coupling cover or on a separate support located within such chamber to enhance the fluid flow through the bearing assembly. A laminate for use in the structures of the coupling cover, the fairwater, struts, vanes and supports is disclosed, wherein the laminate includes a fiber-reinforced toughened epoxy resin layer sandwiched between a vibration-damping elastomer layer and a biocidal elastomer layer; the marine laminate material can be shaped and sized into a marine structure and exhibits desirable marine properties including cavitation-resistance, anti-fouling and vibration damping.

U.S. Pat. No. 5,011,583, which issued to Tanbara on Apr. 30, 1991, describes a corrosion prevention system for a marine propulsion system. A marine propulsion system of the type having a sacrificial anode for corrosion protection of the casing includes structure whereby the propeller is electrically insulated from the casing and the sacrificial anode. The structure includes spacers made of insulating materials, spacers having insulating coatings, or insulating coatings on the surfaces of the propeller or the propeller shaft. Electrical insulation of the propeller prevents unsightly and efficiency-reducing depositions on the propeller surfaces and reduces the required size of the anode.

U.S. Pat. No. 6,173,669, which issued to Staerzl on Jan. 16, 2001, discloses an apparatus and method for inhibiting fouling of an underwater surface. A marine fouling prevention system comprises two conductive surfaces and a device that alternates the direction of electric current between the two surfaces. The current is caused to flow through seawater in which the two surfaces are submerged or partially submerged. A monitor measures the current flowing from one of the two conduction surfaces and compares it to the current flowing into the other conduction surface to assure that no leakage of current of substantial quantity exists. The system applies a low magnitude current density, of approximately 0.10 to 0.50 milliamperes per square foot, for an extended duration of time of approximately 10 to 20 minutes. By alternating current direction between the two surfaces, both surfaces can be provided with sufficient chlorine gas bubbles to prevent marine growth from attaching to the surfaces.

U.S. Pat. No. 6,209,472, which issued to Staerzl on Apr. 3, 2001, discloses an apparatus and method for inhibiting fouling of an underwater surface. A system for inhibiting marine organism growth on underwater surfaces provides an electric current generator which causes an electric current to flow proximate the underwater surface. A source of power, such as a battery, provides electrical power to the electric current generator. The flow of current passes from the underwater surface through water surrounding the surface or in contact with the surface, and a point of ground potential. The point of ground potential can be a marine propulsion system attached to a boat on which the underwater surface is contained.

U.S. Pat. No. 6,547,952, which issued to Staerzl on Apr. 15, 2003, discloses a system for inhibiting fouling of an underwater surface. An electrically conductive surface is combined with a protective surface of glass in order to provide an anode from which electrons can be transferred to seawater for the purpose of generating gaseous chlorine on the surface to be protected. Ambient temperature cure glass (ATC glass) provides a covalent bond on an electrically conductive surface, such as nickel-bearing paint. In this way, boat hulls, submerged portions of outboard motors, and submerged portions of sterndrive systems can be protected effectively from the growth of marine organisms, such as barnacles. The electrically conductive surface generates electrons into the seawater in order to create chlorine gas at the surface which inhibits and discourages marine growth. The protective coating of glass inhibits the migration of metal ions from the electrically conductive surface into the seawater and therefore inhibits corrosive degradation as a result of galvanic action.

The patents described above are hereby expressly incorporated by reference in the description of the present invention.

It is known that various types of coatings, such as paint, can be used to protect surfaces of components that would otherwise be subjected to corrosive attack because of the environment in which they are used. It is also known that composite structures can be attached to the external surfaces of marine drives, such as the systems described in U.S. Pat. Nos. 5,487,687 and 6,468,119. It would be significantly beneficial if an overmolded layer could be quickly and efficiently applied to a marine propulsion system that provides a rugged protective overmolded layer that is more durable than paint and more inexpensively applied than preformed housing elements that are later attached to the marine drive.

SUMMARY OF THE INVENTION

A marine propulsion device made in accordance with the preferred embodiment of the present invention comprises a metallic gear case and polymer overmolded layer that is disposed on an outer surface of the gear case. A metallic gear case, in a particularly preferred embodiment of the present invention, is made of aluminum and the polymer overmolded layer comprises either an unfilled polymer, a glass filled polymer or a carbon filled polymer. In some applications of the present invention, an adhesion promoting substance is used to facilitate the adhesion of the polymer overmolded layer to an outer surface of the gear case. The adhesion promoting substance can be disposed within the polymer overmolded layer before it is applied to the gear case or it can be disposed between the metallic gear case and the polymer overmolded layer prior to the polymer overmolded layer being injection molded around the metallic gear case.

It should be understood that the present invention is applicable for use in conjunction with a complete metallic gear case that is coated with the polymer overmolded layer or, alternatively, the gear case can be a simplified metallic structure that is not, in itself, hydrodynamically shaped with continuous smooth outer metallic surfaces.

In certain embodiments of the present invention, it can further comprise a drive shaft housing that is attached to the gear case. The polymer overmolded layer is disposed on the drive shaft housing.

The thermal coefficient of expansion of the metallic gear case is within a reasonable percentage of the thermal coefficient of expansion of the polymer overmolded layer in a preferred embodiment of the present invention. This inhibits the detachment of the polymer overmolded layer from the outer surface of the metallic gear case as a result of thermal expansions and contractions of the combined structure. If the thermal coefficients of the metallic gear case and the polymer overmolded layer differ by a significant amount, repeated expansions and contractions can result in a detachment of the polymer overmolded layer from the surface of the metallic gear case. If the metal portion of the housing has a thermal coefficient of expansion of approximately $12.8\times10^{-6}$ inches per inch per degree Fahrenheit, the polymer should have a suitable thermal coefficient of expansion in the range of between $4.5\times10^{-6}$ inches per inch per degree Fahrenheit to $80\times10^{-6}$ inches per inch per degree Fahrenheit. However, this should not be considered to be limiting to the present invention. The polymer overmolded layer is held in intimate contact with an outer surface of the gear case with no intended space therebetween. The polymer overmolded layer can be mechanically bonded to the gear case or chemically bonded to the gear case. It should be understood that, although the present invention is described herein as an overmolded layer of polymer material, it is not limited in all embodiments to being made by an overmolding process.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
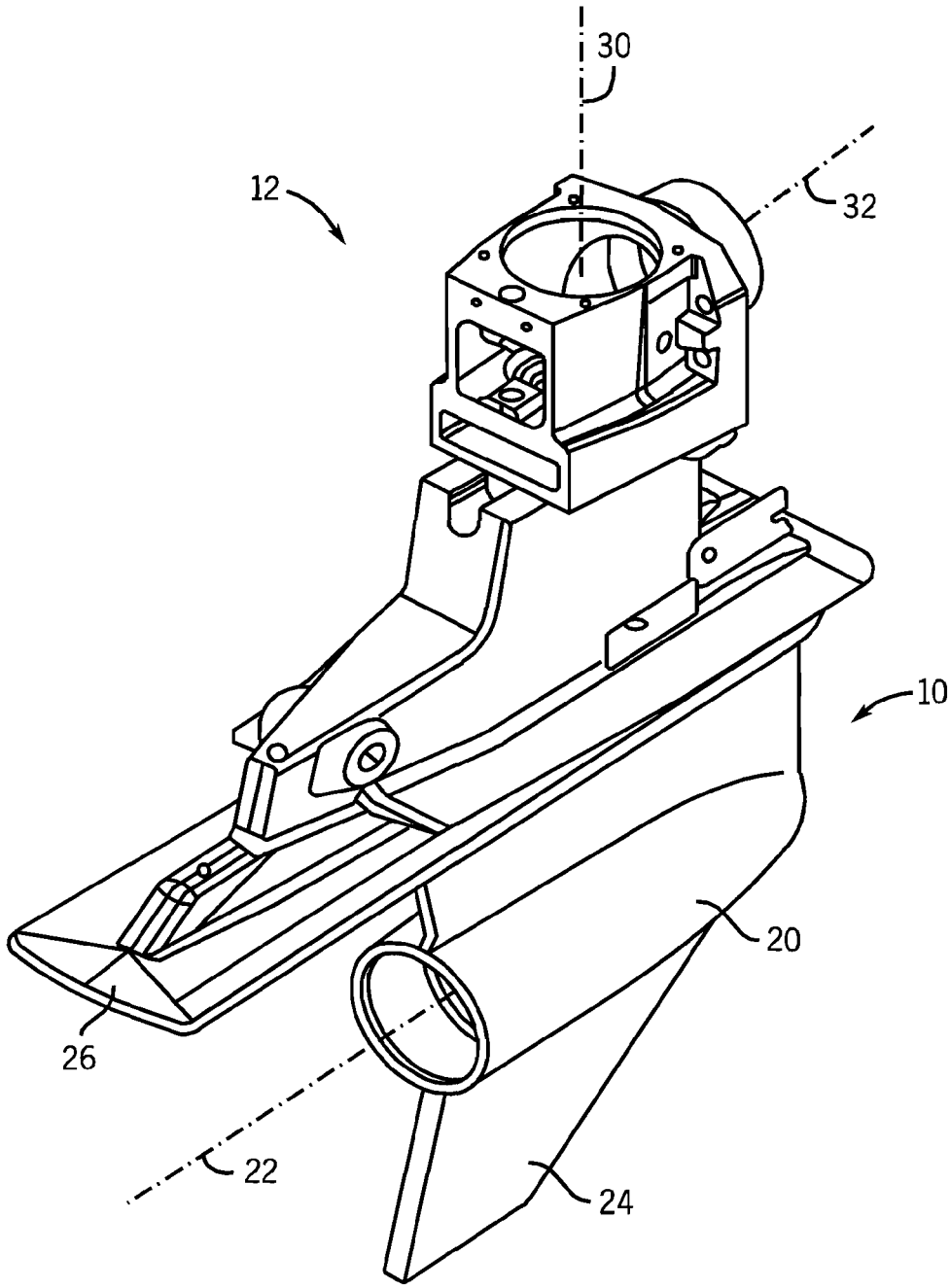
FIG. 1 is an isometric view of a gear case and a drive shaft housing.

Throughout the description of the preferred embodiment of the present invention, like components will be identified by like reference numerals.

FIG. 1 is an isometric view of a gear case 10 combined with a drive shaft housing 12. The gear case structure comprises a section 20 which is shaped to support a propeller shaft for rotation about a propeller shaft axis 22. Those skilled in the art of marine propulsion systems are aware of the basic internal structure of the gear case 10. Also shown in FIG. 1 is a skeg 24 and an antiventilation plate 26. Attached to the gear case 10 is a drive shaft housing 12 which supports the drive shaft for rotation about axis 30 and also supports an inner connecting set of gears which allows the drive shaft to be driven by an output shaft of an engine which rotates about axis 32. Throughout the description of the present invention, illustrations of a certain type of gear case 10 are used. This type of gear case has smooth outer surfaces that are intentionally shaped to be hydrodynamic. The external surface of the gear case 10 is provided with contours which fulfill this purpose. However, it should be understood that since the external metallic surface of the gear case 10 is not intended to be in contact with water because of the subsequent polymer overmolded layer that is applied, the hydrodynamic shape of the outer surface of the gear case 10 is not a necessity. Other steps can be taken to result in a hydrodynamic shape of the exposed surface of the polymer overmolded layer subsequent to its application even though the underlying external surface of the metallic gear case does not, itself, possess hydrodynamically shaped external surface contours.

The present invention relates generally to the overmolding of the components shown in FIG. 1. Prior to assembling the gear case 10 to the drive shaft housing 12, both components can be overmolded with a polymer material to protect the outer surfaces of these metallic components from corrosion. For purposes of clarity and simplicity, the overmolding process will be described below in conjunction with FIGS. 2-4.

Figure 2:
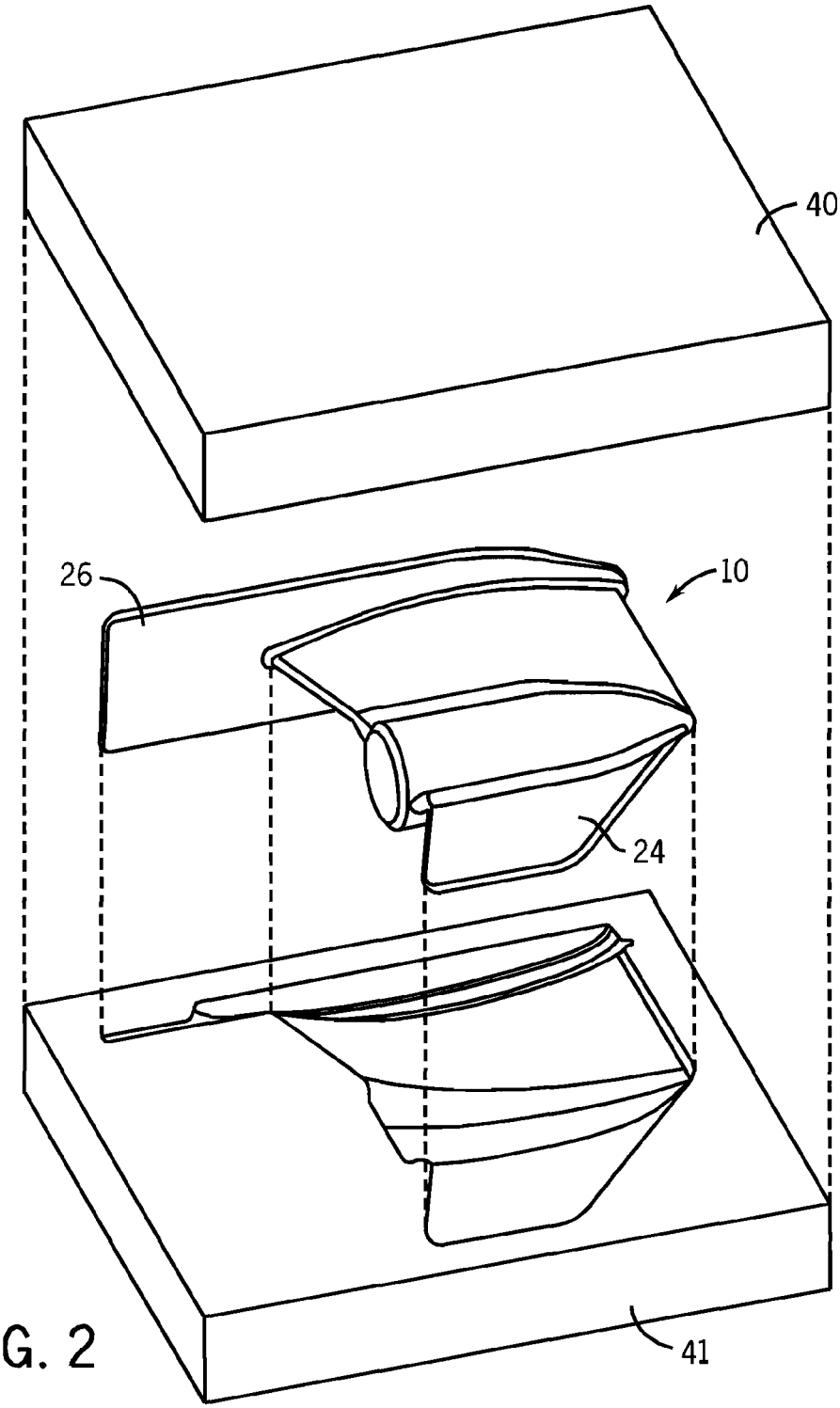
FIG. 2 shows a gear case in association with a mold used in a molding process to apply a thin overmolded layer of polymer material around the outer surface of the gear case.

In FIG. 2, a gear case 10 is shown in relation to a 2-piece mold which comprises first and second segments, 40 and 41, that are shaped to receive the gear case 10 with a preselected magnitude of clearance around all of the outer exposed surfaces of the gear case. After the gear case 10 is placed within the mold cavity, a polymer material is injection molded into the space surrounding the gear case 10. A polymer material, which can be a glass filled polymer or a carbon filled polymer, is intended to emulate the shape of the outer surface of the gear case 10 and become intimately bonded to the outer surface. A polymer that can be used for these purposes can be a material which is sold under the trademark SURLYN, a material sold under the trademark RYNITE and a trademark sold under the name HYTREL, which are all available in commercial quantities from the e.i. DuPont de Nemours and Company Corporation.

It should be understood that the resulting shape of the outer surface of the polymer overmolded layer is partially determined by the outer shape of the item that is being overmolded. The shape of the outer surface of the piece being overmolded, such as the gear case 10, can be the natural outer surface shape of that component or a modified shape that results from combining a gear case structure with additional materials to define a desired outer surface contour. In certain circumstances, it is desirable to combine other materials with the gear case structure in order to allow the outer polymer overmolded layer to be generally uniform in thickness throughout its entire structure.

With continued reference to FIG. 2, a preferred embodiment of the present invention is manufactured through the use of an injection molding machine. In order to enhance the adhesion between the polymer material and the outer surface of the metallic gear case 10, an adhesion promoter can be used. One type of adhesion promoter, which can be mixed directly with the polymer mix prior to the injection molding into the dye, is a rubber compound that is blended into the polymer mix and called Zytel ST801 which is available in commercial quantities from the Dupont Corporation. An adhesion promoter that is typically applied to the surface of the metallic gear case 10 prior to the injection molding process is a compound called Epoxy E120HP which is available in commercial quantities from the Loctite Corporation.

Figure 3:
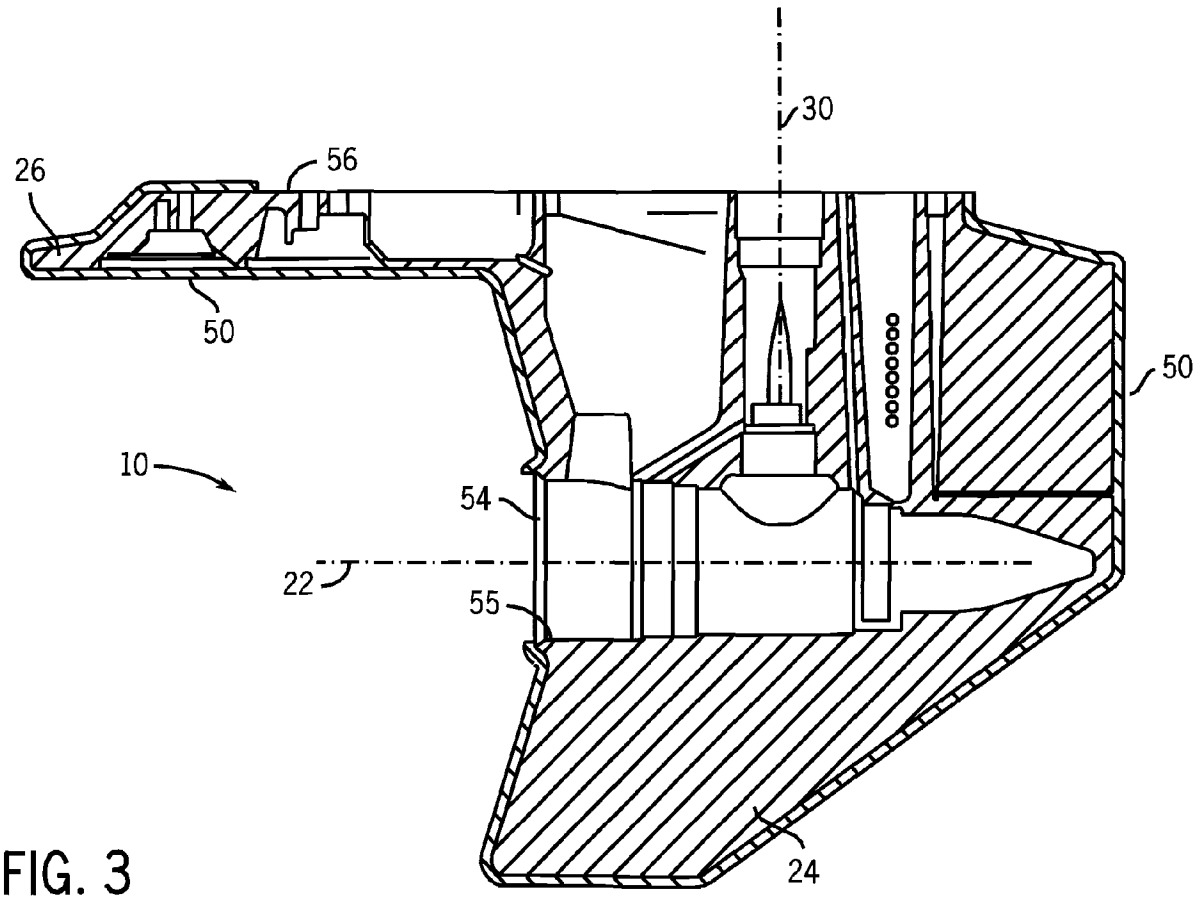
FIG. 3 is a section view of a gear case with a polymer overmolded layer surrounding its exposed outer surfaces.

FIG. 3 is a section view of a gear case 10 after it is removed from the mold such as the one described above in conjunction with FIG. 2. A thin polymer overmolded layer 50 is disposed in intimate contact with the outer surface of the gear case structure. In a preferred embodiment of the present invention, no spaces exist between the inner surface of the polymer overmolded layer 50 and the outer surface of the gear case structure. In other words, the polymer overmolded layer adheres like paint, but is a more rugged material and is generally thicker than paint. As an example, in a typical application of the present invention, the polymer overmolded layer 50 is approximately 0.120 inches thick and this thickness is uniform around the entire exposed surface of the gear case structure. As can be seen, the polymer overmolded layer 50 is intentionally inhibited from coating certain parts of the gear case 10. As an example, the opening 54 where the propeller shaft extends outwardly from the gear case is not coated in FIG. 3. However, it should be understood that in certain embodiments of the present invention it may be preferable to coat a portion of the inner cylindrical surface 55. The surface identified by reference numeral 56 also remains uncoated in the vicinity where it will contact the drive shaft housing 12 which is illustrated in FIG. 1.

Figure 4:
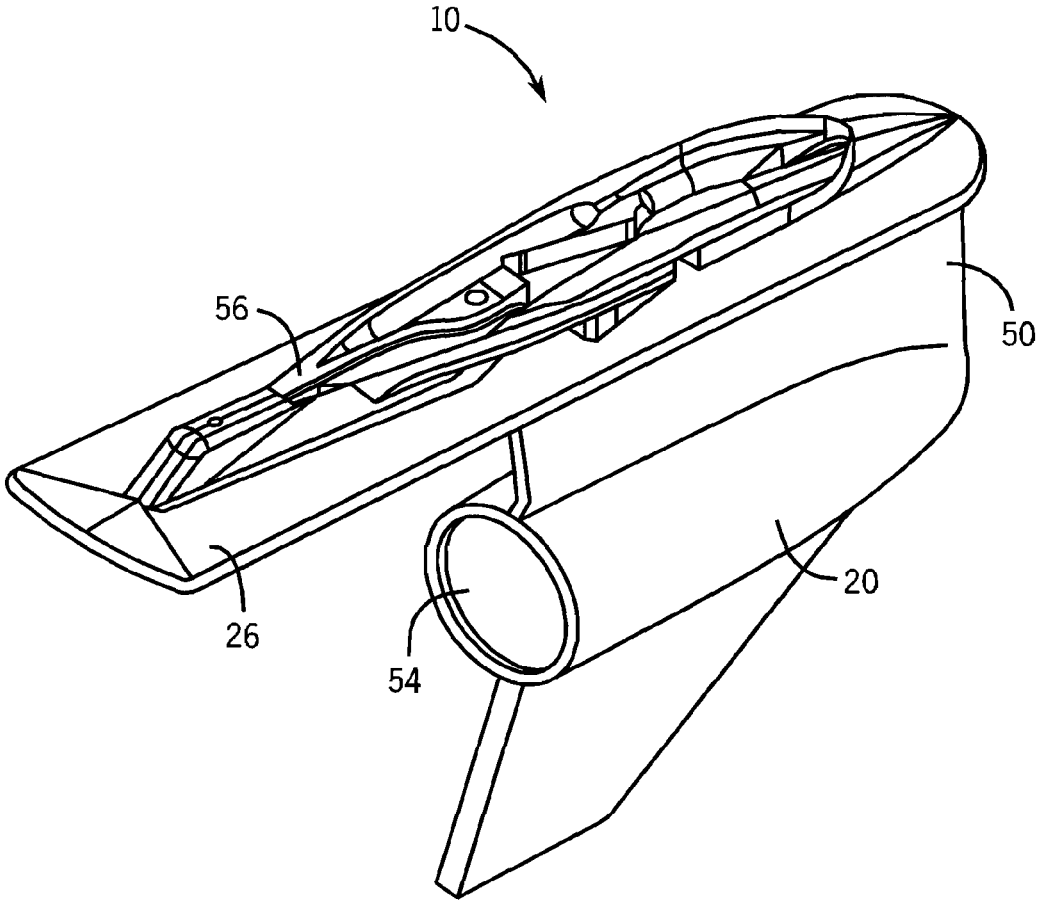
FIG. 4 is an isometric view of a gear case with a polymer overmolded layer applied to its outer surfaces.

FIG. 4 is an isometric view of the gear case 10 which has been coated with the polymer overmolded layer. The normally exposed outer surface of the gear case 10 is completely coated with the polymer overmolded layer 50 which is generally 0.120 inches (3 mm) thick and is adhered to the outer surface of the metallic gear case 10 in an intimate fashion, with no spaces between the inner surface of the polymer overmolded layer 50 and the outer surface of the metallic gear case 10.

The application of the polymer overmolded layer 50 to the metallic gear case 10, in a preferred embodiment of the present invention, is accomplished through a molding process in which molten polymer is injected into a mold to surround the metallic gear case 10 with a uniform thickness of the polymer material. The polymer material can be a glass filled polymer, a carbon filled polymer or any other polymer material that can provide a rugged protective coating for the metallic gear case or the metallic drive shaft housing 12. The polymer material is generally scratch resistant and corrosion resistant to a greater degree than could normally be achieved with paint. An adhesion promoter, such as an epoxy based compound or an elastomeric compound can be incorporated directly to the polymer mix prior to the injection molding process or prior to that process, respectively. The thermal coefficient of the polymer mix is generally selected to be within a suitable range as described above.

In order to facilitate the bonding of the polymer overmolded layer to the outer surface of the metallic gear case or drive shaft housing, a mechanical bond can be enhanced by scoring or abrading the outer surface of the gear case structure to roughen the surface microscopically or provide holes and indentations to enhance the mechanical bond or interlocking between the polymer overmolded layer and the outer surface of the metallic gear case or drive shaft housing. In addition, certain adhesives, such as epoxy, can be used by applying the adhesive prior to the molding process. Enhanced chemical bonding between the polymer overmolded layer and the surface of the metallic gear case 10 or drive shaft housing 12 can be achieved through a chrome conversion process in which the metallic component is first dipped in a chromate containing bath which is commercially available from PPG Corporation. The chemical bonding process can result in either an ionic bond or a covalent bond.

A marine propulsion system made in accordance with the present invention achieves a higher degree of ruggedness and durability than could normally be obtained through the use of paint. In addition, it is less expensive to apply than the known application of plastic components which are mechanically attached around metallic components of a marine propulsion system, such as that described in U.S. Pat. Nos. 6,468,119 and 5,487,687.

Although the present invention has been described in particular detail and illustrated to show a preferred embodiment, it should be understood that alternative embodiments are also within its scope.

The invention claimed is:

1. A marine propulsion device, comprising:

a metallic gear housing structure;

a polymer layer disposed on an outer surface of said gear housing structure;

an adhesion promoting substance to facilitate the adhesion of said polymer layer to an outer surface of said gear housing structure, wherein said adhesion promoting substance is disposed within said polymer layer.

2. A marine propulsion device, comprising:

an aluminum gear housing structure;

a polymer layer disposed on an outer surface of said gear housing structure, said polymer layer being injection molded around said aluminum gear housing structure;

an adhesion promoting substance to facilitate the adhesion of said polymer layer to an outer surface of said gear housing structure, wherein said adhesion promoting substance is disposed within said polymer layer.

3. A marine propulsion device, comprising:

an aluminum gear housing structure;

a polymer layer disposed on an outer surface of said gear housing structure, said polymer layer being injection molded around said aluminum gear housing structure;

wherein said polymer layer is held in intimate contact with an outer surface of said gear housing structure with no space therebetween;

wherein said polymer layer is bonded to said gear housing structure through a plurality of holes formed through said gear housing structure.

* * * * *